US006749651B2

(12) United States Patent
Carabell et al.

(10) Patent No.: US 6,749,651 B2
(45) Date of Patent: Jun. 15, 2004

(54) FUEL ADDITIVE COMPOSITIONS CONTAINING A MANNICH CONDENSATION PRODUCT, A POLY (OXYALKYLENE) MONOOL, AND A CARBOXYLIC ACID

(75) Inventors: Kevin D. Carabell, Fairfax, CA (US); James A. Gray, Novato, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 10/036,764

(22) Filed: Dec. 21, 2001

(65) Prior Publication Data

US 2003/0172582 A1 Sep. 18, 2003

(51) Int. Cl.[7] ..... C10L 1/18; C10L 1/22

(52) U.S. Cl. ..... 44/385; 44/415; 44/443; 44/459

(58) Field of Search ..... 44/385, 415, 443, 44/459

(56) References Cited

U.S. PATENT DOCUMENTS

| | | | | | |
|---|---|---|---|---|---|
| 3,798,247 | A | | 3/1974 | Piasek et al. | 260/404.5 |
| 4,231,759 | A | | 11/1980 | Udelhofen et al. | 44/75 |
| 4,334,085 | A | | 6/1982 | Basalay et al. | 564/367 |
| 4,357,148 | A | | 11/1982 | Graiff | 44/62 |
| 4,877,416 | A | | 10/1989 | Campbell | 44/62 |
| 5,006,130 | A | | 4/1991 | Aiello et al. | 44/432 |
| 5,089,028 | A | * | 2/1992 | Abramo et al. | 44/347 |
| 5,360,460 | A | | 11/1994 | Mozdzen et al. | 44/386 |
| 5,405,419 | A | | 4/1995 | Ansari et al. | 44/412 |
| 5,514,190 | A | | 5/1996 | Cunningham et al. | 44/415 |
| 5,634,951 | A | | 6/1997 | Colucci et al. | 44/415 |
| 5,679,116 | A | * | 10/1997 | Cunningham et al. | 44/359 |
| 5,697,988 | A | | 12/1997 | Malfer et al. | 44/415 |
| 5,876,468 | A | | 3/1999 | Moreton | 44/415 |
| 6,048,373 | A | | 4/2000 | Malfer et al. | 44/415 |
| 6,511,518 | B1 | * | 1/2003 | Houser | 44/385 |
| 6,511,519 | B1 | * | 1/2003 | Ahmadi et al. | 44/385 |

* cited by examiner

*Primary Examiner*—Cephia D. Toomer
(74) *Attorney, Agent, or Firm*—Steven G. K. Lee

(57) ABSTRACT

A fuel additive composition comprising:

a) a Mannich condensation product of (1) a high molecular weight alkyl-substituted hydroxyaromatic compound (2) an amine having the formula:

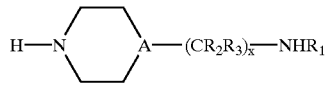

wherein A is CH or nitrogen, $R_1$, $R_2$, $R_3$ are independently hydrogen or lower alkyl of 1 to about 6 carbon atoms and each $R_2$ and $R_3$ is independently selected in each —$CR_2R_3$— unit, and x is an integer from 1 to about 6;

and (3) an aldehyde, wherein the respective molar ratio of reactants (1), (2), and (3) is 1:0.1–2:0.1–2;

b) a hydrocarbyl-terminated poly(oxyalkylene) monool; and c) a carboxylic acid as represented by the formula:

$R_4(COOH)_y$ or anhydride thereof, wherein $R_4$ represents a hydrocarbyl group having about 2 to about 50 carbon atoms, and y represents an integer of 1 to about 4.

91 Claims, No Drawings

FUEL ADDITIVE COMPOSITIONS CONTAINING A MANNICH CONDENSATION PRODUCT, A POLY (OXYALKYLENE) MONOOL, AND A CARBOXYLIC ACID

BACKGROUND OF THE INVENTION

1. Field of the Invention

The present invention relates to a fuel additive composition containing a Mannich condensation product, a hydrocarbyl-terminated poly(oxyalkylene) monool, and a carboxylic acid. In one aspect the present invention relates to the use of the additive composition in a fuel composition to prevent and control engine deposits, particularly engine intake system deposits, such as intake valve deposits. In a further aspect the present invention relates to a method of improving the compatibility of a fuel additive composition.

2. Description of the Related Art

Numerous deposit-forming substances are inherent in hydrocarbon fuels. These substances, when used in internal combustion engines, tend to form deposits on and around constricted areas of the engine contacted by the fuel. Typical areas commonly and sometimes seriously burdened by the formation of deposits include carburetor ports, the throttle body and venturies, engine intake valves, etc.

Deposits adversely affect the operation of the vehicle. For example, deposits on the carburetor throttle body and venturies increase the fuel to air ratio of the gas mixture to the combustion chamber thereby increasing the amount of unburned hydrocarbon and carbon monoxide discharged from the chamber. The high fuel-air ratio also reduces the gas mileage obtainable from the vehicle.

Deposits on the engine intake valves when they get sufficiently heavy, on the other hand, restrict the gas mixture flow into the combustion chamber. This restriction starves the engine of air and fuel and results in a loss of power. Deposits on the valves also increase the probability of valve failure due to burning and improper valve seating. In addition, these deposits may break off and enter the combustion chamber possibly resulting in mechanical damage to the piston, piston rings, engine head, etc.

The formation of these deposits can be inhibited as well as removed by incorporating an active detergent into the fuel. These detergents function to cleanse these deposit-prone areas of the harmful deposits, thereby enhancing engine performance and longevity. There are numerous detergent-type gasoline additives currently available which, to varying degrees, perform these functions.

Mannich condensation products are known in the art as fuel additives for the prevention and control of engine deposits. For example, U.S. Pat. No. 4,231,759, issued Nov. 4, 1980 to Udelhofen et al., discloses reaction products obtained by the Mannich condensation of a high molecular weight alkyl-substituted hydroxyaromatic compound, an amine containing an amino group having at least one active hydrogen atom, and an aldehyde, such as formaldehyde. This patent further teaches that such Mannich condensation products are useful detergent additives in fuels for the control of deposits on carburetor surfaces and intake valves.

U.S. Pat. No. 5,876,468, issued Mar. 2, 1999 to Moreton, discloses a compound comprising a Mannich reaction product of a polyisobutylene-substituted phenol wherein at least 70% of the terminal olefinic double bonds in the polyisobutylene are of the vinylidene type, an aldehyde, and ethylenediamine (EDA). This compound is shown to be a more effective detergent in hydrocarbon fuels than Mannich compounds made from 3-(dimethylamino)propylamine (DMAPA), diethylenetriamine (DETA), and triethylenetetramine (TETA). However, the other compounds are shown to have good detergency properties relative to base fuel. Moreton also discloses an additive package consisting of the EDA Mannich, alkoxylated alkylphenol, and an aromatic solvent.

Generally, Mannich condensation products are utilized in combination with other fuel additive components. For example, polyolefins and polyether compounds are also well known in the art as fuel additives. It is not uncommon for the literature to refer to the enhanced benefits of the combination of two or more such fuel additives for the prevention and control of engine deposits.

U.S. Pat. No. 5,514,190, issued May 7, 1996 to Cunningham et al., discloses a fuel additive composition for the control of intake valve deposits which comprises (a) the Mannich reaction product of a high molecular weight alkyl-substituted phenol, an amine, and an aldehyde, (b) a poly (oxyalkylene) carbamate, and (c) a poly(oxyalkylene) alcohol, glycol or polyol, or a mono or diether thereof.

U.S. Pat. No. 5,634,951, issued Jun. 3, 1997 to Colucci et al., discloses gasoline compositions containing Mannich condensation products as detergents. This patent teaches that carrier fluids, including liquid polyalkylenes, may be added to the compositions to enhance the effectiveness of the Mannich condensation products in minimizing or reducing intake valve deposits and/or intake valve sticking.

U.S. Pat. No. 5,697,988, issued Dec. 16, 1997 to Malfer et al., discloses a fuel additive composition which provides reduced fuel injector, intake valve, and combustion chamber deposits which comprises (a) the Mannich reaction product of a high molecular weight alkyl-substituted phenol, an amine, and an aldehyde, (b) a polyoxyalkylene compound, preferably a polyoxyalkylene glycol or monoether derivative thereof, and (c) optionally a poly-alpha-olefin.

U.S. Pat. No. 6,048,373, issued Apr. 11, 2000 to Malfer et al., discloses a fuel composition comprising (a) a spark-ignition internal combustion fuel, (b) a Mannich detergent; and (c) a polybutene having a molecular weight distribution (Mw/Mn) of 1.4 or below.

U.S. Pat. No. 4,357,148, issued Nov. 2, 1982 to Graiff, discloses the control or reversal of octane requirement increase together with improved fuel economy in a spark ignition internal combustion engine is achieved by introducing with the combustion charge a fuel composition containing an octane requirement increase-inhibiting amount of certain oil-soluble aliphatic polyamines and certain low molecular weight polymers and/or copolymers of monoolefins having up to 6 carbon atoms, in a certain ratio.

U.S. Pat. No. 4,877,416, issued Oct. 31, 1989 to Campbell, discloses a fuel composition which contains (a) from about 0.001 to 1.0 percent by weight of a hydrocarbyl-substituted amine or polyamine having an average molecular weight of about 750 to 10,000 and at least one basic nitrogen atom, and (b) a hydrocarbyl-terminated poly(oxyalkylene) monool having an average molecular weight of about 500 to 5,000, wherein the weight percent of the hydrocarbyl-terminated poly(oxyalkylene) monool in the fuel composition ranges from about 0.01 to 100 times the amount of hydrocarbyl-substituted amine or polyamine.

U.S. Pat. No. 5,006,130, issued Apr. 9, 1991 to Aiello et al., discloses an unleaded gasoline composition containing a mixture of (a) about 2.5 parts per million by weight or higher of basic nitrogen in the form of an oil-soluble aliphatic alkylene polyamine containing at least one olefinic polymer chain, said polyamine having a molecular weight of about 600 to 10,000, and (b) from about 75 to about 125 parts per million by weight based on the fuel composition of certain oil-soluble olefinic polymers, a poly(oxyalkylene) alcohol, glycol or polyol or a mono or di-ether thereof, non-aromatic naphthenic or paraffinic oils or polyalphaolefins. This patent further teaches that, as a matter of practicality, the basic nitrogen content of the aliphatic polyamine component is usually about 4.0 or below and that this generally corresponds to a concentration of about 100 to 160 ppm when the aliphatic polyamine is a 1,050 molecular weight aliphatic diamine, such as N-polyisobutenyl N'-N'-dimethyl-1,3-diaminopropane.

U.S. Pat. No. 5,405,419, issued Apr. 11, 1995 to Ansari et al., discloses a fuel additive composition comprising (a) a fuel-soluble aliphatic hydrocarbyl-substituted amine having at least one basic nitrogen atom wherein the hydrocarbyl group has a number average molecular weight of about 700 to 3,000; (b) a polyolefin polymer of a $C_2$ to $C_6$ monolefin, wherein the polymer has a number average molecular weight of about 350 to 3,000; and (c) a hydrocarbyl-terminated poly(oxyalkylene) monool having an average molecular weight of about 500 to 5,000. This patent further teaches that fuel compositions containing these additives will generally contain about 50 to 500 ppm by weight of the aliphatic amine, about 50 to 1,000 ppm by weight of the polyolefin and about 50 to 1,000 ppm by weight of the poly(oxyalkylene) monool. This patent also discloses that fuel compositions containing 125 ppm each of aliphatic amine, polyolefin and poly(oxyalkylene) monool provide better deposit control performance than compositions containing 125 ppm of aliphatic amine plus 125 ppm of poly (oxyalkylene) monool.

U.S. Pat. No. 3,798,247, issued Mar. 19, 1974 to Piasek and Karll, discloses that the reaction under Mannich condensation conditions, like other chemical reactions, does not go to theoretical completion and some portion of the reactants, generally the amine, remains unreacted or only partially reacted as a coproduct. Unpurified products of Mannich processes also commonly contain small amounts of insoluble particle byproducts of the Mannich condensation reaction that appear to be the high molecular weight condensation product of formaldehyde and polyamines. The amine and amine byproducts lead to haze formation during storage and, in diesel oil formulations, to rapid buildup of diesel engine piston ring groove carbonaceous deposits and skirt varnish. The insoluble or borderline soluble byproducts are substantially incapable of removal by filtration and severely restrict product filtration rate. These drawbacks were overcome by adding long-chain carboxylic acids during the reaction to reduce the amount of solids formation from the Mannich reaction. This was thought to render the particulate polyamine-formaldehyde condensation product soluble through formation of amide-type links. In particular, oleic acid worked well at 0.1 to 0.3 mole/mole of alkylphenol. The quantity of unconsumed or partially reacted amine was not mentioned in the patent.

U.S. Pat. No. 4,334,085, issued Jun. 6, 1982 to Basalay and Udelhofen, discloses that Mannich condensation products can undergo transamination, and use this to solve the problem of byproduct amine-formaldehyde resin formation encountered in U.S. Pat. No. 3,748,247 eliminating the need for using a fatty acid. U.S. Pat. No. 4,334,085 defined transamination as the reaction of a Mannich adduct based on a single-nitrogen amine with a polyamine to exchange the polyamine for the single-nitrogen amine. The examples in this patent infer that the unconsumed amine and partially reacted amine discussed in U.S. Pat. No. 3,798,247 are not merely unconsumed, but must be in chemical equilibrium with the product of the Mannich condensation reaction. In Example 1 of U.S. Pat. No. 4,334,085, a Mannich condensation product is made from 0.5 moles of polyisobutylphenol, 1.0 mole of diethylamine and 1.1 moles of formaldehyde. To 0.05 moles of this product was added 0.05 moles of tetraethylenepentamine (TEPA) and then the mixture was heated to 155° C. while blowing with nitrogen. The TEPA replaced 80 to 95% of the diethylamine in the Mannich as the nitrogen stripped off the diethylamine made available by the equilibrium with the Mannich.

U.S. Pat. No. 5,360,460, issued Nov. 1, 1994 to Mozdzen et al., discloses a fuel additive composition comprising (A) an alkylene oxide condensate or the reaction product thereof and an alcohol, (B) a monocarboxylic fatty acid, and (C) a hydrocarbyl amine, or the reaction product thereof and an alkylene oxide. The fuel additive composition deals with cleaning of injection ports, lubricating a fuel line system in a diesel vehicle, and with minimizing corrosion in the fuel line system. However, the use of a Mannich condensation product is neither disclosed nor suggested.

In the references described above, the emphasis is on fuel additive compositions or components that prevent and control engine deposits, particularly engine intake system deposits. Although this is the primary requirement for commercial application of fuel additive compositions, it is not the only requirement. Among other requirements, the fuel additive composition must not cause any harm to other parts of the engine, must provide other necessary properties such as rust inhibition and water shedding, and must be reasonably stable for handling. Thus, a fuel additive composition will consist of a number of components that result in the achievement of all the desired properties.

One aspect of stability is the compatibility of the fuel additive components when they are blended together to give the desired composition. Sometimes the components may interact and result in the formation of haze, floc, and sediment. If this occurs, the additive composition will not be homogeneous and will result in sedimentation in storage tanks and injection equipment at gasoline blending plants. This will foul the storage tank and possibly plug the injection equipment and any in-line filters.

In the case of Mannich condensation products there is unconverted amine and amine-formaldehyde intermediate present that will vary in concentration according to the particular amine used in the Mannich synthesis. The unconverted amine and amine-formaldehyde intermediate can react with the rust inhibitor, typically a complex organic acid made from natural products such as wood, and form a precipitate and haze. It is possible for such interactions to occur with other components in the fuel additive composition. None of the references above discusses this aspect of Mannich condensation products and how to design a Mannich condensation product for fuel additive applications that maximizes the deposit control performance while minimizing the compatibility problems encountered with fuel additives formulated from a variety of components.

SUMMARY OF THE INVENTION

It has now been discovered that a certain combination of a specific Mannich condensation product, a hydrocarbyl-terminated poly(oxyalkylene) monool, and a carboxylic acid affords a unique fuel additive composition which provides excellent control of engine deposits, particularly engine intake system deposits, such as intake valve deposits. Optionally, the fuel additive composition of the present invention may also contain a polyolefin.

Accordingly, the present invention provides a novel fuel additive composition comprising:

a) a Mannich condensation product of (1) a high molecular weight alkyl-substituted hydroxyaromatic compound wherein the alkyl group has a number average molecular weight of from about 300 to about 5,000 (2) an amine having the formula:

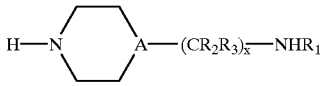

wherein A is CH or nitrogen, $R_1$, $R_2$, $R_3$ are independently hydrogen or lower alkyl of 1 to about 6 carbon atoms and each $R_2$ and $R_3$ is independently selected in each $—CR_2R_3—$ unit, and x is an integer from 1 to about 6;

and (3) an aldehyde, wherein the respective molar ratio of reactants (1), (2), and (3) is 1:0.1–2:0.1–2;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group; and c) a carboxylic acid as represented by the formula:

$$R_4(COOH)_y$$

or anhydride thereof, wherein $R_4$ represents a hydrocarbyl group having about 2 to about 50 carbon atoms, and y represents an integer of 1 to about 4.

The present invention further provides a fuel composition comprising a major amount of hydrocarbons boiling in the gasoline or diesel range and an effective deposit-controlling amount of a fuel additive composition of the present invention.

The present invention still further provides a fuel concentrate comprising an inert stable oleophilic organic solvent boiling in the range of from about 150° F. to about 450° F. and from about 10 to about 90 weight percent of a fuel additive composition of the present invention.

The present invention yet provides a method of improving the compatibility of a fuel additive composition comprising blending together the components of the fuel additive composition of the present invention.

The present invention provides additionally a method of controlling engine deposits in an internal combustion engine by operating an internal combustion engine with a fuel composition of the present invention.

Among other factors, the present invention is based on the surprising discovery that the unique combination of a Mannich condensation product, a hydrocarbyl-terminated poly (oxyalkylene) monool, a polyolefin, and a carboxylic acid provides excellent control of engine deposits, particularly engine intake system deposits, such as intake valve deposits. Optionally, the fuel additive composition of the present invention may also contain a polyolefin. It is not unusual for small quantities of low molecular weight amine and amine-formaldehyde intermediate (both measured as water-soluble amine) in the Mannich condensation product to interact with organic acid mixtures that are typically used in fuel additive formulations to provide anti-corrosion properties, or to interact with carbon dioxide in the air or in inert storage tank gas blanketing mixtures containing carbon dioxide. The interaction can lead to formation of insoluble material, haze, and flocs. Therefore, it is quite surprising that the formulation compatibility and air sensitivity are greatly improved by the presence of a selected carboxylic acid that interacts with the residual amine. In addition, the selected carboxylic acid provides anti-corrosion properties eliminating the need for adding a separate rust inhibitor. Thus, the improved compatibility and air sensitivity manifests itself in less insoluble material, haze, and flocs.

DETAILED DESCRIPTION OF THE INVENTION

The fuel additive composition of the present invention comprises a Mannich condensation product, a hydrocarbyl-terminated poly(oxyalkylene) monool, a carboxylic acid, and, optionally, a polyolefin.

Definitions

Prior to discussing the present invention in detail, the following terms will have the following meanings unless expressly stated to the contrary.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups may also contain aliphatic unsaturation, i.e., olefinic or acetylenic unsaturation, and may contain minor amounts of heteroatoms, such as oxygen or nitrogen, or halogens, such as chlorine. When used in conjunction with carboxylic fatty acids, hydrocarbyl will also include olefinic unsaturation.

The term "alkyl" refers to both straight- and branched-chain alkyl groups.

The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "alkylene" refers to straight- and branched-chain alkylene groups having at least 1 carbon atom. Typical alkylene groups include, for example, methylene ($—CH_2—$), ethylene ($—CH_2CH_2—$), propylene ($—CH_2CH_2CH_2—$), isopropylene ($—CH(CH_3)CH_2—$), n-butylene ($—CH_2CH_2CH_2CH_2—$), sec-butylene ($—CH(CH_2CH_3)CH_2—$), n-pentylene ($—CH_2CH_2CH_2CH_2CH_2—$), and the like.

The term "polyoxyalkylene" refers to a polymer or oligomer having the general formula:

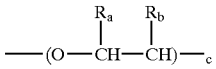

wherein $R_a$ and $R_b$ are each independently hydrogen or lower alkyl groups, and c is an integer from about 5 to about 100. When referring herein to the number of oxyalkylene units in a particular polyoxyalkylene compound, it is to be understood that this number refers to the average number of oxyalkylene units in such compounds unless expressly stated to the contrary.

The term "fuel" or "hydrocarbon fuel" refers to normally liquid hydrocarbons having boiling points in the range of gasoline and diesel fuels.

The Mannich Condensation Product

Mannich reaction products employed in this invention are obtained by condensing an alkyl-substituted hydroxyaromatic compound whose alkyl-substituent has a number average molecular weight of from about 300 to about 5,000, preferably polyalkylphenol whose polyalkyl substituent is derived from 1-mono-olefin polymers having a number average molecular weight of from about 300 to about 5,000, more preferably from about 400 to about 3,000; a cyclic amine containing a primary and secondary amino group or two secondary amino groups; and an aldehyde, preferably formaldehyde, in the presence of a solvent.

The overall reaction may be illustrated by the following:

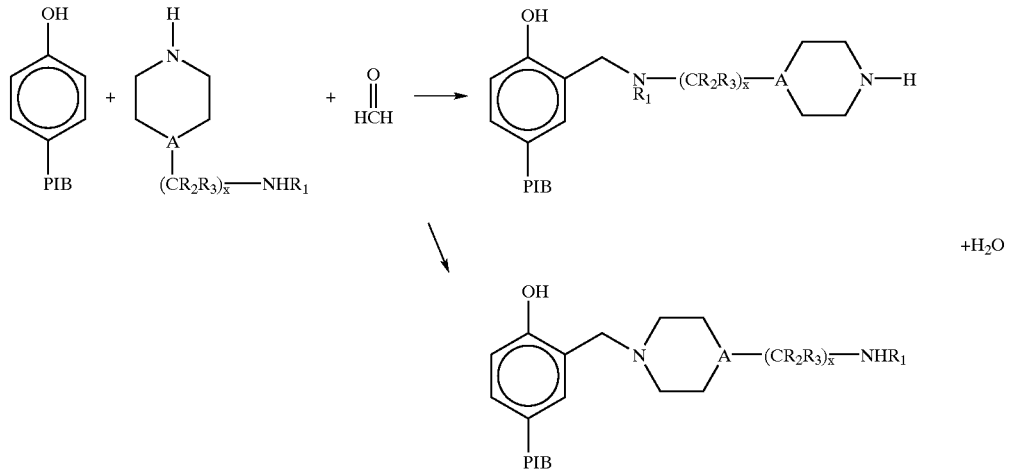

wherein A, $R_1$, $R_2$, $R_3$ and x are as defined herein.

High molecular weight Mannich reaction products useful as additives in the fuel additive compositions of this invention are preferably prepared according to conventional methods employed for the preparation of Mannich condensation products, using the above-named reactants in the respective molar ratios of high molecular weight alkyl-substituted hydroxyaromatic compound, amine, and aldehyde of approximately 1:0.1–2:0.1–2. Preferably, the respective molar ratios will be 1:0.5–1.5:0.5–1.5. More preferably, the respective molar ratios will be 1:0.8–1.3:0.8–1.3. A suitable condensation procedure involves adding at a temperature of from room temperature to about 95° C., the formaldehyde reagent (e.g., formalin) to a mixture of amine and alkyl-substituted hydroxyaromatic compounds alone or in an easily removed organic solvent, such as benzene, xylene, or toluene or in solvent-refined neutral oil, and then heating the reaction mixture at an elevated temperature (about 120° C. to about 175° C.) while the water of reaction is distilled overhead and separated. The reaction product so obtained is finished by filtration and dilution with solvent as desired.

The most preferred Mannich reaction product additives employed in this invention are derived from high molecular weight Mannich condensation products, formed by reacting an alkylphenol, an amine of the present invention, and a formaldehyde affording reactants in the respective molar ratio of 1:1:1.05, wherein the alkyl group of the alkylphenol has a number average weight of from about 300 to about 5,000.

Representative of the high molecular weight alkyl-substituted hydroxyaromatic compounds are polypropylphenol, polybutylphenol, and other polyalkylphenols, with polyisobutylphenol being the most preferred. Polyalkylphenols may be obtained by the alkylation, in the presence of an alkylating catalyst such as $BF_3$, of phenol with high molecular weight polypropylene, polybutylene, and other polyalkylene compounds to give alkyl substituents on the benzene ring of phenol having a number average molecular weight of from about 300 to about 5,000.

The alkyl substituents on the hydroxyaromatic compounds may be derived from high molecular weight polypropylenes, polybutenes, and other polymers of mono-olefins, principally 1-mono-olefins. Also useful are copolymers of mono-olefins with monomers copolymerizable therewith, wherein the copolymer molecule contains at least about 90% by weight of mono-olefin units. Specific examples are copolymers of butenes (1-butene, 2-butene, and isobutylene) with monomers copolymerizable therewith wherein the copolymer molecule contains at least about 90% by weight of propylene and butene units, respectively. Said monomers copolymerizable with propylene or said butenes include monomers containing a small proportion of unreactive polar groups, such as chloro, bromo, keto, ether, or aldehyde, which do not appreciably lower the oil-solubility of the polymer. The comonomers polymerized with propylene or said butenes may be aliphatic and can also contain non-aliphatic groups, e.g., styrene, methylstyrene, p-dimethylstyrene, divinyl benzene, and the like. From the foregoing limitation placed on the monomer copolymerized with propylene or said butenes, it is clear that said polymers and copolymers of propylene and said butenes are substantially aliphatic hydrocarbon polymers. Thus, the resulting alkylated phenols contain substantially alkyl hydrocarbon substitutents having a number average molecular weight of from about 300 to about 5,000.

In addition to the foregoing high molecular weight hydroxyaromatic compounds, other phenolic compounds which may be used include, high molecular weight alkyl-substituted derivatives of resorcinol, hydroquinone, cresol, cathechol, xylenol, hydroxy-di-phenyl, benzylphenol, phenethylphenol, naphthol, tolylnaphthol, among others. Preferred for the preparation of such preferred Mannich condensation products are the polyalkylphenol reactants, e.g., polypropylphenol and polybutylphenol, particularly polyisobutylphenol, whose alkyl group has a number average molecular weight of about 300 to about 5,000, preferably about 400 to about 3,000, more preferably about 500 to about 2,000, and most preferably about 700 to about 1,500.

As noted above, the polyalkyl substituent on the polyalkyl hydroxyaromatic compounds employed in the invention may be generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl hydroxyaromatic compounds are polyisobutenes which comprise at least about 20% of the more reactive methylvinylidene isomer, preferably at least about 50% and more preferably at least about 70% methylvinylidene isomer. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 10, a polyisobutene having a molecular weight of about 950 and a methylvinylidene content of about 76%, and Ultravis 30, a polyisobutene having a molecular weight of about 1,300 and a methylvinylidene content of about 74%, both available from British Petroleum, and Glissopal 1000, 1300, and 2200, available from BASF.

The preferred configuration of the alkyl-substituted hydroxyaromatic compound is that of a para-substituted mono-alkylphenol. However, any alkylphenol readily reactive in the Mannich condensation reaction may be employed. Accordingly, ortho mono-alkylphenols and dialkylphenols are suitable for use in this invention.

Another important consideration in the present invention is the choice of the amine used to make the Mannich condensation product. When one and only one nitrogen in the amine is available for the Mannich condensation reaction (for example, 3-(dimethylamino)propylamine, as disclosed in U.S. Pat. No. 5,634,951), the concentration of unconverted amine and amine-formaldehyde intermediate are relatively low. On the other hand, an amine like diethylenetriamine contains two primary and one secondary nitrogens. The Mannich base made from diethylenetriamine under the same conditions as the prior art case will have an excessive amount of unconverted amine that is too expensive to remove or to stabilize with oleic acid. The amines used in the present invention will result in the unconverted amine being at a manageable concentration in the Mannich condensation product, namely about the same concentration as obtained with 3-(dimethylamino)propylamine. Thus, we have surprisingly found that amines of a particular structure that have both a primary and a secondary nitrogen or two secondary nitrogens available for the Mannich condensation reaction give the same relatively low amount of unconverted amine as does the prior art case using an amine with only one primary or secondary amino group. In addition, deposit control performance is excellent and formulation compatibility is greatly improved by the addition of a selected carboxylic acid.

The amine of the present invention contains both a primary and a secondary reactive amino group or two secondary amino groups that can participate in the Mannich reaction. The general structure of the amine is illustrated by the following formula:

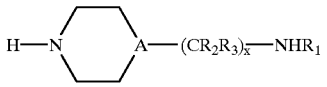

wherein A is CH or nitrogen, $R_1$, $R_2$, $R_3$ are independently hydrogen or lower alkyl having from 1 to about 6 carbon atoms, and x is an integer 1 to about 6. Preferably, A is CH or nitrogen, $R_1$ is hydrogen, $R_2$ and $R_3$ are independently hydrogen or lower alkyl having from 1 to about 4 carbon atoms, and x is an integer 1 to about 4. More preferably, A is CH or nitrogen, $R_1$, is hydrogen, $R_2$ and $R_3$ are independently hydrogen or lower alkyl having from 1 to about 2 carbon atoms, and x is an integer of about 2. Most preferably, A is nitrogen, $R_1$, $R_2$, $R_3$ are hydrogen, and x is an integer of about 2. In each of the preceding, each $R_2$ and $R_3$ is independently selected in each —$CR_2R_3$— unit.

Examples of amines are 1-piperazinemethanamine, 1-piperazineethanamine, 1-piperazinepropanamine, 1-piperazinebutanamine, α-methyl-1-piperazinepropanamine, N-ethyl-1-piperazineethanamine, N-(1,4-dimethylpentyl)-1-piperazineethanamine, 1-[2-(dodecylamino)ethyl]-piperazine, 1-[2-(tetradecylamino)ethyl]-piperazine, 4-piperidinemethanamine, 4-piperidineethanamine, 4-piperidinebutanamine, and N-phenyl-4-piperidinepropanamine. The most preferred amine of the Mannich condensation product of the present invention is 1-piperazineethanamine or 1-(2-aminoethyl) piperazine (AEP).

Representative aldehydes for use in the preparation of the high molecular weight Mannich reaction products employed in this invention include the aliphatic aldehydes such as formaldehyde, acetaldehyde, propionaldehyde, butyraldehyde, valeraldehyde, caproaldehyde, heptaldehyde, and stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The Hydrocarbyl-Terminated Poly(Oxyalkylene) Monool

The hydrocarbyl-terminated poly(oxyalkylene) polymers employed in the present invention are monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of lower alkylene oxides, such as ethylene oxide, propylene oxide, the butylene oxides, or the pentylene oxides to the hydroxy compound $R_3OH$ under polymerization conditions, wherein $R_3$ is the hydrocarbyl group which caps the poly(oxyalkylene) chain. Methods of production and properties of these polymers are disclosed in U.S. Pat. Nos. 2,841,479 and 2,782,240 and Kirk-Othmer's "Encyclopedia of Chemical Technology", $2^{nd}$ Ed Volume 19, p. 507. In the polymerization reaction, a single type of alkylene oxide may be employed, e.g., propylene oxide, in which case the product is a homopolymer, e.g., a poly(oxyalkylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxide is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxyalkylene) alcohol.

In general, the poly(oxyalkylene) polymers are mixtures of compounds that differ in polymer chain length. However, their properties closely approximate those of the polymer represented by the average composition and molecular weight.

The polyethers employed in this invention can be represented by the formula:

$$R_5O—(R_6O)_z—H$$

wherein $R_5$ is a hydrocarbyl group of from 1 to about 30 carbon atoms; $R_6$ is a $C_2$ to $C_5$ alkylene group; and z is an integer such that the molecular weight of the polyether is from about 500 to about 5,000.

Preferably, $R_5$ is a $C_7$ to $C_{30}$ alkylphenyl group. Most preferably, $R_5$ is dodecylphenyl.

Preferably, $R_6$ is a $C_3$ or $C_4$ alkylene group. Most preferably, $R_6$ is a $C_3$ alkylene group.

Preferably, the polyether has a molecular weight of from about 750 to about 3,000; and more preferably from about 900 to about 1,500.

The Carboxylic Acid

The fuel additive composition of the present invention further contains a carboxylic acid compound. The carboxylic acid to be employed in the invention preferably is a compound which is represented by the formula:

$$R_4(COOH)_y$$

or anhydride thereof, wherein $R_4$ represents a hydrocarbyl group having about 2 to about 50 carbon atoms, and y represents an integer of 1 to about 4.

The preferred hydrocarbyl groups are aliphatic groups, such as an alkyl group or an alkenyl group, which may have a straight chain or a branched chain. Examples of preferred carboxylic acids are aliphatic acids having about 8 to about 30 carbon atoms and include caprylic acid, pelargonic acid, capric acid, lauric acid, myristic acid, palmitic acid, margaric acid, stearic acid, isostearic acid, arachidic acid, behenic acid, lignoceric acid, cerotic acid, montanic acid, melissic acid, caproleic acid, palmitoleic acid, oleic acid, eraidic acid, linolic acid, linoleic acid, fatty acid or coconut oil, fatty acid of hardened fish oil, fatty acid of hardened rapeseed oil, fatty acid of hardened tallow oil, and fatty acid of hardened palm oil. The examples further include dodecenyl succinic acid and its anhydride. Preferably, the carboxylic acid is oleic acid.

The Polyolefin Polymer

The fuel additive composition of the present invention may further contain a polyolefin. When a polyolefin polymer component is employed in the fuel additive composition of the invention, it is a polyolefin polymer of a $C_2$ to $C_6$ mono-olefin, wherein the polyolefin polymer has a number average molecular weight of about 500 to about 3,000. The polyolefin polymer may be a homopolymer or a copolymer. Block copolymers are also suitable for use in this invention.

In general, the polyolefin polymer will have a number average molecular weight of about 500 to about 3,000, preferably about 700 to about 2,500, and more preferably from about 750 to about 1,800. Particularly preferred polyolefin polymers will have a number average molecular weight of about 750 to about 1,500.

The polyolefin polymers employed in the present invention are generally polyolefins that are polymers or copolymers of mono-olefins, particularly 1-mono-olefins, such as ethylene, propylene, butylene, and the like. Preferably, the mono-olefin employed will have about 2 to about 4 carbon atoms, and more preferably, about 3 to about 4 carbon atoms. More preferred mono-olefins include propylene and butylene, particularly isobutylene. Polyolefins prepared from such mono-olefins include polypropylene and polybutene, especially polyisobutene.

Examples of suitable polyisobutenes include conventional polyisobutenes having a number average molecular weight of about 700 to about 2,500, such as Parapol 950, a polyisobutene having a number average molecular weight of about 950, available from ExxonMobil Chemical Company.

Improved Compatibility

One aspect of the present invention is a method of improving the compatibility of a fuel additive composition which comprises blending together:

a) a Mannich condensation product of (1) a high molecular weight alkyl-substituted hydroxyaromatic compound wherein the alkyl group has a number average molecular weight of from about 300 to about 5,000 (2) an amine having the formula:

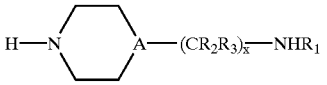

wherein A, $R_1$, $R_2$, $R_3$, and x is as herein defined above. and (3) an aldehyde, wherein the respective molar ratio of reactants (1), (2), and (3) is 1:0.1–2:0.1–2;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group; and c) a carboxylic acid as represented by the formula:

$$R_4(COOH)_y$$

or anhydride thereof, wherein $R_4$ represents a hydrocarbyl group having about 2 to about 50 carbon atoms, and y represents an integer of 1 to about 4; wherein the Mannich condensation product and the carboxylic acid are blended together at a temperature ranging from about room temperature (about 20° C.) to about 100° C.

In general, the amount of carboxylic acid is 1 to about 15%, more preferably, about 2 to about 10%, most preferably about 3 to about 8%, of the weight of the Mannich condensation product, or there is preferably about 0.2 to about 2.5, more preferably, about 0.3 to about 1.6, and most preferably, about 0.5 to about 1.3, equivalents of carboxylic acid per equivalent of water-soluble amine in the Mannich condensation product.

In fuel additive applications, the presence of small amounts of low molecular weight amine in dispersant components such as the Mannich condensation product can lead to formulation incompatibilities (for example, with certain corrosion inhibitors or demulsifiers) and air sensitivity (for example, reaction with carbon dioxide in the air). For example, corrosion inhibitors are typically complex mixtures of organic acids of wide molecular weight range. These can react with low amounts (<1 wt %) of low molecular weight amines in the Mannich component at room temperature to form insoluble salts and at higher temperatures to form insoluble amides. Formulation incompatibility and air sensitivity are manifested by formation of haze, floc, solids, and/or gelatinous material in the formulation over time. The incompatibility may occur in the absence of air. Consequently, the manufacturing process for amine components of fuel additive formulations may include a step to remove low molecular weight amines to low levels, or the compatibility issue may be addressed during formulation. However, the unique chemistry of Mannich condensation products must be considered with either approach. In particular, the chemical equilibrium can generate additional low molecular weight amines if the product is heated too much during the purification step or after a formulation has been prepared. Therefore, there is a need for either an economical process to reduce the unconverted amine and the amine-formaldehyde intermediate to a low level after the Mannich reaction or a chemical scavenger that renders the unconverted amine harmless to formulation compatibility. The carboxylic acid treatment of the Mannich condensation product of the present invention provides improved compatibility with other additives in the desired finished fuel additive composition. Compatibility in this instance generally means that the components in the present invention as well as being fuel soluble in the applicable treat rate also do not cause other additives to precipitate under normal conditions. The improved compatibility manifests itself in less insoluble material, haze, and flocs.

Fuel Compositions

The fuel additive composition of the present invention will generally be employed in hydrocarbon fuels to prevent and control engine deposits, particularly intake valve deposits, in internal combustion engines, including, but not limited to, Direct Injection Spark Ignition engines. Typically, the desired control of engine deposits will be achieved by operating an internal combustion engine with a fuel composition containing the additive composition of the present invention. The proper concentration of additive necessary to achieve the desired control of engine deposits varies depending upon the type of fuel employed, the type of engine, engine oil, operating conditions and the presence of other fuel additives.

Generally, the present fuel additive composition will be employed in a hydrocarbon fuel in a concentration ranging from about 31 to about 4,000 parts per million (ppm) by weight, preferably from about 51 to about 2,500 ppm.

In terms of individual components, hydrocarbon fuel containing the fuel additive composition of the present invention will generally contain about 20 to about 1,000 ppm, preferably about 30 to about 400 ppm, of the Mannich condensation product component, about 10 to about 4,000 ppm, preferably about 20 to about 800 ppm, of the hydrocarbyl-terminated poly(oxyalkylene) monool component, and 1 to about 100, preferably 1 to about 20 ppm of the carboxylic acid. The weight ratio of the Mannich condensation product to hydrocarbyl-terminated poly (oxyalkylene) monool to carboxylic acid will generally range from about 100:50:1 to about 100:400:10, and will preferably be about 100:50:1 to about 100:300:5.

When a polyolefin is employed in the fuel additive composition of the present invention, the hydrocarbon fuel containing the fuel additive composition will generally contain about 20 to about 1,000 ppm, preferably about 30 to about 400 ppm, of the Mannich condensation product component, about 5 to about 2,000 ppm, preferably about 10 to about 400 ppm, of the hydrocarbyl-terminated poly (oxyalkylene) monool component, about 5 to about 2,000 ppm, preferably about 10 to about 400 ppm of the polyolefin, and 1 to about 100, preferably 1 to about 20 ppm of the carboxylic acid. The weight ratio of the Mannich condensation product to hydrocarbyl-terminated poly(oxyalkylene) monool to carboxylic acid will generally range from about 100:25:25:1 to about 100:200:200:10, and will preferably be about 100:25:25:1 to about 100:150:150:5.

Preferably, the Mannich condensation product and carboxylic acid will be blended together at a temperature ranging from about room temperature (about 20° C.) to about 100° C., more preferably from about room temperature to about 75° C., and most preferably, from about room temperature to about 60° C.

The fuel additive composition of the present invention may be formulated as a concentrate using an inert stable oleophilic (i.e., dissolves in gasoline) organic solvent boiling in the range of about 150° F. to about 450° F. (about 65° C. to about 232° C.). Preferably, an aliphatic or an aromatic hydrocarbon solvent is used, such as benzene, toluene, xylene, or higher-boiling aromatics or aromatic thinners. Aliphatic alcohols containing about 3 to about 13 carbon atoms, such as isopropanol, isobutylcarbinol, n-butanol, 2-ethylhexanol, tert-butyl alcohol, decyl alcohol, tridecyl alcohol and the like, in combination with hydrocarbon solvents are also suitable for use with the present additives. In the concentrate, the amount of the additive will generally range from about 10 to about 70 weight percent, preferably about 10 to about 50 weight percent, more preferably from about 20 to about 40 weight percent.

In gasoline fuels, other fuel additives may be employed with the additive composition of the present invention, including, for example, oxygenates, such as t-butyl methyl ether, antiknock agents, such as methylcyclopentadienyl manganese tricarbonyl, and other dispersants/detergents, such as hydrocarbyl amines, or succinimides. Additionally, antioxidants, corrosion inhibitors, metal deactivators, demulsifiers, other inhibitors, and carburetor or fuel injector detergents may be present.

In diesel fuels, other well-known additives can be employed, such as pour point depressants, flow improvers, lubricity improvers, cetane improvers, and the like.

The gasoline and diesel fuels employed with the fuel additive composition of the present invention include clean burning gasoline where levels of sulfur, aromatics, and olefins range from typical amounts to only trace amounts and clean burning diesel fuel where levels of sulfur and aromatics range from typical amounts to only trace amounts.

A fuel-soluble, nonvolatile carrier fluid or oil may also be used with the fuel additive composition of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic fluid, such as mineral oil, refined petroleum oils, synthetic polyalkanes and alkenes, including hydrogenated and unhydrogenated polyalphaolefins, and synthetic polyoxyalkylene-derived fluids, such as those described, for example, in U.S. Pat. No. 4,191,537 to Lewis, and polyesters, such as those described, for example, in U.S. Pat. Nos. 3,756,793 to Robinson and 5,004,478 to Vogel et al., and in European Patent Application Nos. 356,726, published Mar. 7, 1990, and 382,159, published Aug. 16, 1990.

These carrier fluids are believed to act as a carrier for the fuel additive composition of the present invention and to assist in the control of engine deposits, particularly engine intake system deposits, such as the intake valves. The carrier fluid may also exhibit synergistic engine deposit control properties when used in combination with the fuel additive composition of this invention.

The carrier fluids are typically employed in amounts ranging from about 25 to about 5,000 ppm by weight of the hydrocarbon fuel, preferably from about 100 to about 3,000 ppm of the fuel. Preferably, the ratio of carrier fluid to fuel additive will range from about 0.2:1 to about 10:1, more preferably from about 0.5:1 to about 3:1.

When employed in a fuel concentrate, carrier fluids will generally be present in amounts ranging from about 20 to about 60 weight percent, preferably from about 30 to about 50 weight percent.

EXAMPLES

The invention will be further illustrated by the following examples, which set forth particularly advantageous specific embodiments of the present invention. While the examples are provided to illustrate the present invention, it is not intended to limit it.

In the following examples and tables, the components of the fuel additive composition are defined as follows:

A. The term "Mannich" refers to a Mannich condensation product made from the reaction of polyisobutylphenol, an amine of the present invention, and paraformaldehyde in a ratio of 1:0.1–2:0.1–2 prepared in the manner as described in Example 1. The polyisobutylphenol was produced from polyisobutylene containing at least 70% methylvinylidene isomer as described in U.S. Pat. No. 5,300,701.

B. The term "POPA" refers to a dodecylphenyl-terminated poly(oxypropylene) monool having an average molecular weight of about 1,000.

C. The Oleic Acid was available as Edenor Ti 05 or Emersol 221 from Cognis Corporation as well as from J. T. Baker Company and other suppliers.

D. The term "950 MW PIB" refers to a 950 molecular weight conventional polyisobutylene, such as Parapol 950 from Exxon-Mobil Chemical Company.

EXAMPLE 1

Mannich Condensation Product

Several diluted Mannich condensation products using polyisobutylphenol, 1-(2-aminoethyl)piperazine (AEP), and various amounts of paraformaldehyde (PF) were prepared. Table 1 lists the Mannich samples where CMR is the charge mole ratio of polyisobutylphenol:AEP:paraformaldehyde, % N is the total nitrogen content, % NVR is the nonvolatile residue, WSA is the water-soluble amine content of the Mannich in milliequivalents per gram. Water-soluble amine is measured as described later in Example 1 and is an indicator of the amount of unconverted amine and amine-formaldehyde intermediate.

TABLE 1

Mannich Samples Made at various Charge Mole Ratios

| Sample | Amine | CMR | % N | % NVR | WSA |
|---|---|---|---|---|---|
| 1A | AEP | 1:1:1.05 | 2.60 | 70.1 | 0.219 |
| 1B | AEP | 1:1:1.05 | 2.55 | 69.6 | 0.207 |
| 1C | AEP | 1:1:1.33 | 2.52 | 70.7 | 0.114 |
| 1D | AEP | 1:1:2 | 2.44 | 71.4 | 0.023 |

The following procedure based on a charge mole ratio of 1:1:1.05 polyisobutylphenol:AEP:PF illustrates the synthesis procedure.

2738 g of a solution of polyisobutylphenol in C9 aromatic solvent (Solvarex 9 manufactured by TotalFinaElf) was charged to a 5-L cylindrical glass reactor equipped with baffles, agitator, heating mantle, condenser, Dean-Stark trap, temperature and pressure control system. The polyisobutylphenol was produced from polyisobutylene containing at least 70% methylvinylidene isomer as described in U.S. Pat. No. 5,300,701. The polyisobutylphenol solution had a nonvolatile residue content of 73.9% and a hydroxyl number of 41.4 mg KOH/g. The diluted polyisobutylphenol was warmed to 60–65° C. and then 263.9 g of 1-(2-aminoethyl) piperazine (AEP) was pumped from a 500-mL burette into the reactor over 10 minutes. 160 g of Exxon Aromatic 100 solvent was added to the burette to flush any remaining amine into the reactor. The AEP had an assay of 99.0% was charged to the reactor in the ratio 1.0 mole of AEP per mole of polyisobutylphenol. The AEP was thoroughly mixed with the polyisobutylphenol for 15 minutes, and then 68.9 g of paraformaldehyde (prill form, 92.5% purity, from Hoechst-Celanese) was quickly charged to the reactor. This amount of paraformaldehyde corresponded to 1.05 moles of formaldehyde per mole of polyisobutylphenol. The reactor headspace was purged continuously with nitrogen at about 100 $cm^3$/min while holding the reactor at atmospheric pressure. After agitating the reaction mixture for 15 minutes, the temperature was increased to 175° C. over 1.6 hours. As byproduct water formed, water and solvent vapor distilled from the reactor and passed up through the condenser to the Dean-Stark receiver. The byproduct water and solvent were separated in the receiver and the solvent returned to the reactor once the receiver was filled. The reaction mixture was held at 175° C. for 5 hours and the pressure controlled at atmospheric pressure with nitrogen purge. Most of the byproduct water was removed within the first two hours of the hold period and the reflux eventually stopped. At the end of the hold period, the nitrogen was turned off, the pressure was lowered to 9–10 psia and the reactor heated to maintain temperature so as to cause refluxing for approximately 30 minutes. This removed a small amount of additional byproduct water. The crude reaction product was cooled to ambient temperature and a 69.4-g sample of crude was found to contain 0.05 vol % sediment and 75.8% nonvolatile residue (about 24.2% solvent). The overhead receiver contained 44.8 g of aqueous phase and 90.3 g of solvent phase. 250 g of Exxon Aromatic 100 solvent and 10 g of Manville HyFlo Super Cel filter-aid were mixed into the crude product at about 60–65° C. The crude was filtered using a cylindrical pressure filter having an area of $1.113\times10^{-2}$ $m^2$ and precoated with 16 g of HyFlo Super Cel filter-aid. The crude was filtered at 65° C. and 90 psig and gave a filtrate rate of 857 $kg/h/m^2$.

The filtered Mannich condensation product was clear (0% haze using Nippon Denshoku Model 300A haze meter) and was light gold in color (2.0 by ASTM D1500). A 3-gram sample of the Mannich condensation product was diluted with 100 mL of hexane and 0.1 mL of demulsifier and then extracted twice with 40 mL of warm water. The water extract was titrated with 0.1 N hydrochloric acid. The water-soluble amine content was measured as 0.219 mEq/g.

EXAMPLE 2 (Comparative)

Compatibility and Air Sensitivity of Formulations with Mannich Condensation Products A standard test formulation was blended at room temperature with Mannich condensation products, similar to those in Example 1, and was used to test the effect of water-soluble amine concentration in the Mannich product on the compatibility and air sensitivity of the formulation. Polybutene was not included in the formulation since we were primarily concerned with the interaction between the Mannich condensation product and the corrosion inhibitor or the demulsifier. The objective was to uncover interactions with these particular formulation components or with air that results in the formation of haze, floc, and sediment in the formulation, thus degrading its appearance. The standard test formulation is shown in Table 2. Light alkylate solvent is an aromatic solvent manufactured by Chevron Oronite S.A.

TABLE 2

Typical Compatibility and Air Sensitivity Test Formulation

| Component | Weight Percent |
|---|---|
| Mannich condensation product | 30 |
| Light alkylate solvent | 38.8 |
| Synthetic carrier fluid (POPA) | 30 |
| Demulsifier | 0.4 |
| Corrosion inhibitor | 0.8 |

Mannich condensation product formulation compatibility is measured at room temperature in a 100-mL cylindrical oil sample bottle made of clear glass and filled with the formulation. A cork is inserted into the mouth of the bottle to keep out air. The sample is stored in a rack open to the light in the room. Two qualitative visual rating scales are used; one for fluid appearance with ratings in the range of 0 to 6, and one for the amount of sedimentation with ratings in the range 0 to 4. A low rating number indicates good compatibility and a high rating number indicates poor compatibility. For example, an appearance rating of 6 means the formulation contained heavy cloud (close to opaque). A rating of 4 for sedimentation indicates the presence of a large amount of sediment in the bottom of the bottle. The typical requirement for a pass in this test is a fluid appearance rating in the range of 0 to 2 (absolutely bright to slight cloud) and a sedimentation rating 0 to 1 (no sediment to very slight sediment).

The air sensitivity of the test formulation containing treated Mannich condensation product is measured at room temperature using about 100 g of sample in a 250-mL beaker that is open to the air. A 500-mL beaker is inverted over the 250-mL beaker to keep out air drafts that would quickly cause solvent evaporation, while still allowing equilibration with the surrounding air. The beaker is weighed at the end to make sure the weight loss due to solvent evaporation is less than about 5%. If enough solvent is lost, phase separation can occur. The air sensitivity test uses the same rating scales as the compatibility test. Both tests are supplemented when possible with haze measurements using a Nippon Denshoku Model 300A haze meter.

Diluted Mannich condensation products from Example 1 were evaluated in the compatibility test for up to 30 days as shown in Table 3. The diluted Mannich condensation product samples from Examples 1A and 1C caused failures in the formulation compatibility test by 30 days, while formulations from the product of Example 1D passed the compatibility test through 30 days. Table 3 shows that the compatibility improves as the amount of water-soluble amine in the Mannich condensation product decreases. Samples that have water-soluble amine concentrations below about 0.05 mEq/g pass the compatibility test after 30 days.

The percent haze after 30 days for the three formulations in Table 3 decreased as the water-soluble amine in the Mannich condensation product decreased. The amount of water-soluble amine in the Mannich condensation product from Example 1D was low enough that there was no problem passing the formulation compatibility test at 30 days. Percent haze over about 10 to 20% is very noticeable by the naked eye and is considered unacceptable.

The sediment formed in a typical Mannich formulation was analyzed by Infrared spectroscopy (IR) and nuclear magnetic spectroscopy (NMR). The results indicated that the haze and sediment were caused by a reaction of the carboxylic acid corrosion inhibitor with the residual amine in the Mannich condensation product.

Comparative air sensitivity tests were also conducted on formulations with the Mannich condensation products from Example 1. The results are shown in Table 4. Only formulations made with Mannich condensation product containing low amounts of water-soluble amine passed the air sensitivity test, namely, the test formulation made from Example 1D.

TABLE 3

Comparative Test Formulation Compatibility with Untreated Mannich Condensation Product

| Example[a] | WSA[b] | Blend Number | Fluid/Sediment Rating in Compatibility Test: Initial | 7-days | 30-days | % Haze (30-days) |
|---|---|---|---|---|---|---|
| 1A | 0.219 | 151 | 6/0 | 6/0 | 6/3 | 48.9 |
| 1C | 0.114 | 138 | 2/0 | 3/1 | 3/4 | 19.8 |
| 1D | 0.023 | 134 | 0/0 | 0/0 | 0/0 | 0.2 |

[a]See Table 1 of Example 1.
[b]Water-soluble amine content.

TABLE 4

Comparative Test Formulation Air Sensitivity with Untreated Mannich Condensation Product

| Example[a] | WSA[b] | Blend Number | Fluid/Sediment Rating in Air Sensitivity Test: Initial | 7-days | 30-days | % Haze (30-days) |
|---|---|---|---|---|---|---|
| 1A | 0.219 | 151 | 6/0 | 6/0 | 3/3 | 21.8 |
| 1C | 0.114 | 138 | 2/0 | 3/1 | 2/2 | 7.8 |
| 1D | 0.023 | 134 | 0/0 | 0/0 | 0/0 | 0.5 |

[a]See Table 1 of Example 1.
[b]Water-soluble amine content.

EXAMPLE 3

Improvement of Test Formulation Compatibility and Air Sensitivity Using Mannich Condensation Product Stabilized with Oleic Acid Diluted Mannich condensation product of Example 1A was "stabilized" with various amounts of oleic acid and evaluated in the standard test formulation for compatibility up to 30 days as follows. 65 g of the filtered Mannich condensation product was added to a 250–450-mL beaker on a stir plate. 5.2 g of oleic acid from Baker Chemical was added at room temperature and stirred with the filtered Mannich condensation product. This yielded a "stabilized" Mannich condensation product. The remaining fuel additive formulation ingredients were added into the beaker sequentially with one minute of stirring between each component addition. Temperatures above about 100° C. for the oleic acid treatment of the Mannich are not recommended because the Mannich will tend to equilibrate and generate more amine and amine-formaldehyde intermediate. Table 5 shows the results of these tests. In Table 5, "3% oleic acid" means that 100 g of Mannich condensation product of Example 1A was combined with 3 g of oleic acid. These data show that 3% oleic acid is enough to stabilize the Mannich condensation product from Example 1A in the formulation compatibility test for 30-days. Adding more oleic acid than 3% does not hurt the standard test formulation compatibility.

TABLE 5

Test Formulation Compatibility of Mannich Condensation Product from Example 1 Treated With Oleic Acid

| Blend # | % Oleic Acid | Fluid/Sediment Rating in Compatibility Test 1-day | 3-days | 7-days | 14-days | 21-days | 30-days | % Haze (30-days) |
|---|---|---|---|---|---|---|---|---|
| 144 | 3 | 0/0 | | 0/0 | 0/0 | | 1/0 | 3.6 |
| 176 | 8 | 0/0 | 0/0 | 0/0 | 0/0 | 0/0 | 0/0 | 0.0 |
| 177 | 10 | 0/0 | 0/0 | 0/0 | 0/0 | 0/0 | 0/0 | 0.0 |

We would expect the diluted Mannich condensation product in Example 1C to respond the same way as Example 1A to the oleic acid treatment since Example 1A is a more severe case in terms of the amount of unconverted amine. Example 1C Mannich condensation product contains about half as much unconverted amine as Example 1A Mannich condensation product.

The Mannich condensation product of Example 1A was "stabilized" with various amounts of oleic acid as described in Example 3 and evaluated in test formulation air sensitivity tests for 30 days. Table 6 shows the results of these tests. The air sensitivity test is much more difficult to pass at 30-days than the compatibility test. While all amounts of oleic acid from 3–10% resulted in a significant improvement of test formulation air sensitivity, Table 6 shows that 8% oleic acid is needed to pass the test at 30-days.

Using a maximum fluid/sediment rating of 2/1 as a pass in the test, the test formulation air sensitivity in Table 6 was acceptable up to about 7 days for Blend 144,14 days for Blends 156–157, and 30 days for Blend 158. Blends 176–177 easily passed the air sensitivity test at 30 days. All of these formulations did well in the test compared to Blend 151 in Table 4.

TABLE 6

Test Formulation Air Sensitivity of Mannich Condensation Product from Example 1 Treated With Oleic Acid

| Blend # | % Oleic Acid | Fluid/Sediment Rating in Air Sensitivity Test 1-day | 3-days | 7-days | 14-days | 21-days | 30-days | % Haze (30-days) |
|---|---|---|---|---|---|---|---|---|
| 144 | 3 | 0/0 | | 3/0 | 3/2 | | 2/3 | 7.1 |
| 156 | 4 | 1/0 | 1/0 | 1/1 | 0/2 | 0/2 | 1/2 | 3.3 |
| 157 | 5 | 0/0 | 1/0 | 1/1 | 0/2 | 0/2 | 1/2 | 3.1 |
| 158 | 6 | 0/0 | 0/0 | 0/1 | 0/1 | 0/1 | 1/2 | 2.7 |
| 176 | 8 | 0/0 | 0/0 | 0/0 | 0/0 | 0/0 | 0/0 | 0.1 |
| 177 | 10 | 0/0 | 0/0 | 0/0 | 0/0 | 0/0 | 0/0 | 0.0 |

None of these samples exhibit typical sediment, but rather the formation of very small gelatinous droplets that accumulate on the bottom and the side of the beaker at the air interface. It appears the material forms at the air interface and some of it settles to the bottom of the beaker. In previous work, a sample of the gelatinous material from a formulation made with a diethylenetriamine (DETA)-Mannich condensation product was recovered and analyzed by IR, proton-NMR, and carbon-NMR. It was determined to be a DETA-carbamate salt formed by the reaction of $CO_2$ in the air with DETA. Therefore, we believe the unconverted amine in the AEP-Mannich also reacts with $CO_2$ in the air to form a gelatinous carbamate salt.

The air sensitivity test is a very severe test for a fuel additive formulation, and in some cases may be unnecessary. For example, if the formulation is stored in a tank in which the vapor space is purged with nitrogen, then the applicability of this test is questionable. In the case of incidental exposure to air of the formulation in a tank with high turnover, certainly the Mannich condensation product of Example 1 with 3–4% oleic acid would ensure adequate air sensitivity as well as formulation compatibility during the storage period.

EXAMPLE 4

Ford 2.3L Engine Dynamometer Testing

The fuel additive composition of the present invention was tested in a 1994 four-cylinder Ford 2.3L engine dynamometer test stand to evaluate intake system deposit control performance. The four-cylinder Ford 2.3L engine is port fuel injected and has twin spark plugs. The engine is prepared for tests in accordance with accepted engine testing practices. The engine test is 60 hours in length and consists of 277 repetitions of a 13-minute cycle. The details of the test cycle for the Ford 2.3L engine are set forth in Table 7.

TABLE 7

Ford 2.3 L Engine Dynamometer Test Cycle

| Cycle Step Duration (Seconds) | Engine Speed (RPM) | Engine Manifold Absolute Pressure (Millimeters of Mercury) |
|---|---|---|
| 270 | 2000 | 230 |
| 510 | 2800 | 539 |
| Total: 780 | | |

Using Sample 1B prepared in Example 1, the test results from the Ford 2.3L Engine Dynamometer Test are set forth in Table 8.

TABLE 8

Ford 2.3 L Engine Dynamometer Test Results

| Sample | Mannich (ppm) | Oleic Acid (ppm) | POPA (ppm) | Ratio of POPA/ Mannich | AVG IVD (mg./vlv.) |
|---|---|---|---|---|---|
| Base | 0 | 0 | 0 | — | 435 |
| 4A (Comp) | 74 | 0 | 50 | 1:1 | 502 |
| 4B (Comp) | 74 | 0 | 50 | 1:1 | 500 |
| 4C | 74 | 5.95 | 50 | 1:1 | 462 |
| 4D | 74 | 5.95 | 50 | 1:1 | 409 |

As can be seen in Samples 4C and 4D in Table 8, addition of oleic acid Provides an unexpected reduction in IVD mass relative to comparative Samples 4A and 4B.

EXAMPLE 5

Ford 2.3L Engine Dynamometer Testing

Formulations of Mannich condensation products made with different amines and charge mole ratios were evaluated by the Ford 2.3L Engine Dynamometer Test according to the details described in Example 4. The Mannich samples were made from diethylenetriamine (DETA) following a procedure similar to Example 1.

The test results from the Ford 2.3L Engine Dynamometer Test are set forth in Table 9. As can be seen by comparing the average of Samples 5B and 5C in Table 9 to Sample 5A, the lower paraformaldehyde charge mole to amine ratio provides an unexpected reduction in IVD mass for the Mannich made with the 2-AEP amine. Comparing the average of Samples 5Fand 5G to the average of Samples 5D and 5E shows that the lower paraformaldehyde charge mole to amine ratio provides an unexpected reduction in IVD mass for a Mannich made with diethylenetriamine (DETA) as well.

TABLE 9

Ford 2.3 L Engine Dynamometer Test Results

| Sample | Mannich (ppm) | Oleic Acid (ppm) | POPA (ppm) | PIB (ppm) | Amine | CM Ratio[a] | RUN IVD (mg./vlv.) | AVG IVD (mg./vlv.) |
|---|---|---|---|---|---|---|---|---|
| Base | 0 | 0 | 0 | 0 | — | — | 732 | 732 |
| 5A | 63 | 1.8 | 20 | 20 | 2-AEP | 1:1:2 | 676 | 676 |
| 5B | 61 | 1.8 | 20 | 20 | 2-AEP | 1:1:1.33 | 94 | 86 |
| 5C | 61 | 1.8 | 20 | 20 | 2-AEP | 1:1:1.33 | 79 | |
| 5D | 62 | 1.8 | 20 | 20 | DETA | 1:1:3 | 135 | 187 |
| 5E | 62 | 1.8 | 20 | 20 | DETA | 1:1:3 | 240 | |
| 5F | 62 | 1.8 | 20 | 20 | DETA | 1:1:2 | 157 | 121 |
| 5G | 62 | 1.8 | 20 | 20 | DETA | 1:1:2 | 84 | |

[a]CM refers to the charge mole ratio of polyisobutylphenol:AEP:paraformaldehyde.

EXAMPLE 10

Daimler-Benz M102E 2.3L Engine Dynamometer Testing

Two comparative Mannich condensation products were prepared from 3-(dimethylamino)propylamine (DMAPA) and diethylenetriamine (DETA) by procedures similar to Example 1. The fuel additive composition of the present invention, using sample 1A from Example 1, as well as formulations of two comparative Mannich condensation products were tested in a four-cylinder Daimler-Benz 2.3L engine dynamometer test stand to evaluate intake system deposit control performance. The four-cylinder Daimler Benz 2.3L engine has KE-Jetronic fuel metering. The engine is prepared for tests in accordance with accepted engine testing practices. The engine test is 60 hours in length and consists of 800 repetitions of a 270-second cycle.

The details of the test cycle for the M102E engine are set forth in Table 10.

TABLE 10

Daimler-Benz M102E 2.3 L Engine Dynamometer

| Cycle Step Duration (Seconds) | Test Cycle Engine Speed (RPM) | Engine Torque (Nm) |
|---|---|---|
| 30 | 800 | 0.0 |
| 60 | 1300 | 29.4 |
| 120 | 1850 | 32.5 |
| 60 | 3000 | 35.0 |
| Total: 270 | | |

The test results from the Daimler-Benz M102E Engine Dynamometer Test are set forth in Table 11.

The results shown in Table 11 indicate that a reduction in the polyisobutylphenol:amine:PF charge mole ratio to 1:1:1.05 provides an unexpected reduction in IVD mass relative to Sample 10A. While all three amines demonstrated an improvement in IVD deposits, the Mannich condensation product made with AEP at a charge mole ratio of 1:1:1.05 provides lower IVD mass improvement when compared to DETA and dimethylaminopropylamine (DMAPA).

EXAMPLE 11

Effect of Oleic Acid Treatment on Anti-Corrosion Properties

Corrosion tests according to ASTM D665A were carried out to demonstrate the effect of oleic acid treatment on the anti-corrosion properties of a formulation based on Mannich. The Mannich product was prepared as in Example 1 using AEP as the amine, having a charge mole ratio of 1:1:1.05. The D665A test is the most common corrosion test for evaluating anti-corrosion performance of gasoline in dynamic conditions, such as in vehicles or pipelines. In this test a polished cylindrical steel specimen was immersed in a mixture of 300-mL gasoline and 30-mL water. The mixture was stirred for 24 hours at room temperature (about 20° C.). At the end of this period the steel specimen was rated for the degree of corrosion which had occurred. In this example a 49-state Federal gasoline and a California gasoline were evaluated with and without Mannich formulations. The results are shown below in Table 12. The Mannich formulation was a mixture of Mannich with a synthetic carrier (POPA) and oleic acid (117, 75 and 9 mg/kg, respectively). Adding the Mannich formulation with oleic acid (Formulation "A") to the base gasoline improved the corrosion performance to such a degree that there is no need to add a corrosion inhibitor.

TABLE 11

Daimler-Benz M102E Engine Dynamometer Test Results

| Sample | Mannich (ppm) | Oleic Acid (ppm) | POPA (ppm) | PIB (ppm) | Amine | CM Ratio | RUN IVD (mg./vlv.) | AVG IVD (mg./vlv.) |
|---|---|---|---|---|---|---|---|---|
| 10A | 187 | 5.5 | 62.5 | 62.5 | DETA | 1:1:2 | 122 | 122 |
| 10B | 186 | 5.5 | 62.5 | 62.5 | 2-AEP | 1:1:1.05 | 22 | 27 |
| 10C | 186 | 5.5 | 62.5 | 62.5 | 2-AEP | 1:1:1.05 | 31 | |
| 10D | 182 | 5.5 | 62.5 | 62.5 | DETA | 1:1:1.05 | 53 | 38 |
| 10E | 182 | 5.5 | 62.5 | 62.5 | DETA | 1:1:1.05 | 23 | |
| 10F | 183 | 5.5 | 62.5 | 62.5 | DMAPA | 1:1:1.05 | 50 | 35 |
| 10G | 183 | 5.5 | 62.5 | 62.5 | DMAPA | 1:1:1.05 | 19 | |

[a]CM refers to the charge mole ratio of polyisobutylphenol:AEP:paraformaldehyde.

TABLE 12

| Anti-corrosion Properties | | | | |
|---|---|---|---|---|
| | Base gasoline | | | |
| | Federal RUL[a] | | California RUL | |
| Additive package | No | A | no | A |
| Components, mg/kg | | | | |
| Mannich condensation product | 0 | 117 | 0 | 117 |
| Oleic acid | 0 | 9 | 0 | 9 |
| Synthetic carrier fluid (POPA) | 0 | 75 | 0 | 75 |
| Corrosion inhibitor | 0 | 0 | 0 | 0 |
| Total mg/kg | 0 | 201 | 0 | 201 |
| ASTM D665A Results (in duplicate) | | | | |
| Corrosion rating | D/E | A/A | C/C | A/A |

| Rating | Test Surface Rusted, % |
|---|---|
| A | None |
| B++ | <0.1% |
| B+ | <5% |
| B | 5–25% |
| C | 26–50% |
| D | 51–75% |
| E | 76–100% |

[a]RUL refers to regular unleaded gasoline.

The use of the above-specified reactant ratios together with the use of a certain amine referred to herein have shown to result in the provision of novel Mannich condensation products having excellent performance capabilities and physical properties.

While the present invention has been described with reference to specific embodiments, this application is intended to cover those various changes and substitutions that may be made by those skilled in the art without departing from the spirit and scope of the appended claims.

What is claimed is:

1. A fuel additive composition comprising:

a) a Mannich condensation product of (1) a high molecular weight alkyl-substituted hydroxyaromatic compound wherein the alkyl group has a number average molecular weight of from about 300 to about 5,000 (2) an amine having the formula:

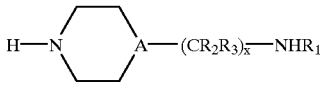

wherein A is CH or nitrogen, $R_1$, $R_2$, $R_3$ are independently hydrogen or lower alkyl of 1 to about 6 carbon atoms and each $R_2$ and $R_3$ is independently selected in each —$CR_2R_3$— unit, and x is an integer from 1 to about 6;

and (3) an aldehyde, wherein the respective molar ratio of reactants (1), (2), and (3) is 1:0.1–2:0.1–2;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group; and c) a carboxylic acid as represented by the formula:

$R_4(COOH)_y$ or anhydride thereof, wherein $R_4$ represents a hydrocarbyl group having about 2 to about 50 carbon atoms, and y represents an integer of 1 to about 4.

2. The fuel additive composition according to claim 1, wherein the alkyl group on said alkyl-substituted hydroxyaromatic compound has a number average molecular weight of about 400 to about 3,000.

3. The fuel additive composition according to claim 2, wherein the alkyl group on said alkyl-substituted hydroxyaromatic compound has a number average molecular weight of about 500 to about 2,000.

4. The fuel additive composition according to claim 3, wherein the alkyl group on said alkyl-substituted hydroxyaromatic compound has a number average molecular weight of about 700 to about 1,500.

5. The fuel additive composition according to claim 1, wherein said alkyl-substituted hydroxyaromatic compound is a polyalkylphenol.

6. The fuel additive composition according to claim 5, wherein the polyalkylphenol is polypropylphenol or polyisobutylphenol.

7. The fuel additive composition according to claim 6, wherein the polyalkylphenol is polyisobutylphenol.

8. The fuel additive composition according to claim 7, wherein the polyisobutylphenol is derived from polyisobutene containing at least about 70% methylvinylidene isomer.

9. The fuel additive composition according to claim 1, wherein A is CH or nitrogen, $R_1$ is hydrogen, $R_2$ and $R_3$ are independently hydrogen or lower alkyl having from 1 to about 4 carbon atoms, and x is an integer from 1 to about 4.

10. The fuel additive composition according to claim 9, wherein A is CH or nitrogen, $R_1$ is hydrogen, $R_2$ and $R_3$ are independently hydrogen or lower alkyl having from 1 to about 2 carbon atoms, and x is an integer of about 2.

11. The fuel additive composition according to claim 10, wherein A is nitrogen, $R_1$, $R_2$, and $R_3$ are hydrogen, and x is an integer of about 2.

12. The fuel additive composition according to claim 1, wherein the aldehyde component of said Mannich condensation product is formaldehyde, paraformaldehyde, or formalin.

13. The fuel additive composition according to claim 1, wherein the respective molar ratio of reactants (1), (2), and (3) is 1:0.5–1.5:0.5–1.5.

14. The fuel additive composition according to claim 1, wherein the respective molar ratio of reactants (1), (2), and (3) is 1:0.8–1.3:0.8–1.3.

15. The fuel additive composition according to claim 1, wherein the respective molar ratio of reactants (1), (2), and (3) is 1:1:1.05.

16. The fuel additive composition according to claim 1, wherein said hydrocarbyl-terminated poly(oxyalkylene) monool has an average molecular weight of about 900 to about 1,500.

17. The fuel additive composition according to claim 1, wherein the oxyalkylene group of the hydrocarbyl-terminated polyoxyalkylene group of said hydrocarbyl-terminated poly(oxyalkylene) monool is a $C_3$ to $C_4$ oxyalkylene group.

18. The fuel additive composition according to claim 17, wherein the oxyalkylene group of said hydrocarbyl-terminated poly(oxyalkylene) monool is a $C_3$ oxypropylene group.

19. The fuel additive composition according to claim 17, wherein the oxyalkylene group of said hydrocarbyl-terminated poly(oxyalkylene) monool is a $C_4$ oxybutylene group.

20. The fuel additive composition according to claim 1, wherein the hydrocarbyl group of said hydrocarbyl-terminated poly(oxyalkylene) monool is a $C_7$ to $C_{30}$ alkylphenyl group.

21. The fuel additive composition according to claim 1, wherein said carboxylic acid is 1 to about 15% of the weight of the Mannich condensation product.

22. The fuel additive composition according to claim 1, wherein $R_4$ represents a hydrocarbyl group having about 8 to about 30 carbon atoms and y represents an integer of 1.

23. The fuel additive composition according to claim 22, wherein $R_4$ represents a hydrocarbyl group having about 17 carbon atoms and y represents an integer of 1.

24. The fuel additive composition according to claim 1, further comprising a polyolefin polymer of a $C_2$ to $C_6$ mono-olefin, wherein the polymer has a number average molecular weight of about 500 to about 3,000.

25. The fuel additive composition according to claim 24, wherein the polyolefin polymer has a number average molecular weight of about 700 to about 2,500.

26. The fuel additive composition according to claim 25, wherein the polyolefin polymer has a number average molecular weight of about 750 to about 1,800.

27. The fuel additive composition according to claim 26 wherein the polyolefin polymer is a polymer of a $C_2$ to $C_4$ mono-olefin.

28. The fuel additive composition according to claim 27, wherein the polyolefin polymer is polypropylene or polybutene.

29. The fuel additive composition according to claim 28, wherein the polyolefin polymer is polyisobutene.

30. A fuel composition comprising a major amount of hydrocarbon fuel boiling in the gasoline or diesel range and an effective deposit controlling amount of a fuel additive composition comprising:

a) a Mannich condensation product of (1) a high molecular weight alkyl-substituted hydroxyaromatic compound wherein the alkyl group has a number average molecular weight of from about 300 to about 5,000 (2) an amine having the formula:

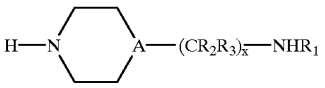

wherein A is CH or nitrogen, $R_1$, $R_2$, $R_3$ are independently hydrogen or lower alkyl of 1 to about 6 carbon atoms and each $R_2$ and $R_3$ is independently selected in each —$CR_2R_3$— unit, and x is an integer from 1 to about 6;

and (3) an aldehyde, wherein the respective molar ratio of reactants (1), (2), and (3) is 1:0.1–2:0.1–2;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group; and c) a carboxylic acid as represented by the formula:

$$R_4(COOH)_y$$

or anhydride thereof, wherein $R_4$ represents a hydrocarbyl group having about 2 to about 50 carbon atoms, and y represents an integer of 1 to about 4.

31. The fuel composition according to claim 30, wherein the alkyl group on said alkyl-substituted hydroxyaromatic compound has a number average molecular weight of about 400 to about 3,000.

32. The fuel composition according to claim 31, wherein the alkyl group on said alkyl-substituted hydroxyaromatic compound has a number average molecular weight of about 500 to about 2,000.

33. The fuel composition according to claim 32, wherein the alkyl group on said alkyl-substituted hydroxyaromatic compound has a number average molecular weight of about 700 to about 1,500.

34. The fuel composition according to claim 30, wherein the alkyl-substituted hydroxyaromatic compound is a polyalkylphenol.

35. The fuel composition according to claim 34, wherein the polyalkylphenol is polypropylphenol or polyisobutylphenol.

36. The fuel composition according to claim 35, wherein the polyalkylphenol is polyisobutylphenol.

37. The fuel composition according to claim 36, wherein the polyisobutylphenol is derived from polyisobutene containing at least about 70% methylvinylidene isomer.

38. The fuel composition according to claim 30, wherein A is CH or nitrogen, $R_1$ is hydrogen, $R_2$ and $R_3$ are independently hydrogen or lower alkyl having from 1 to about 4 carbon atoms, and x is an integer 1 to about 4.

39. The fuel composition according to claim 38, wherein A is CH or nitrogen, $R_1$ is hydrogen, $R_2$ and $R_3$ are independently hydrogen or lower alkyl having from 1 to about 2 carbon atoms, and x is an integer of about 2.

40. The fuel composition according to claim 39, wherein A is nitrogen, $R_1$, $R_2$, and $R_3$ are hydrogen, and x is an integer of about 2.

41. The fuel composition according to claim 30, wherein the aldehyde component of said Mannich condensation product is formaldehyde, paraformaldehyde, or formalin.

42. The fuel composition according to claim 30, wherein the respective molar ratio of reactants (1), (2), and (3) is 1:0.5–1.5:0.5–1.5.

43. The fuel composition according to claim 30, wherein the respective molar ratio of reactants (1), (2), and (3) is 1:0.8–1.3:0.8–1.3.

44. The fuel composition according to claim 30, wherein the respective molar ratio of reactants (1), (2), and (3) is 1:1:1.05.

45. The fuel composition according to claim 30, wherein said the hydrocarbyl-terminated poly(oxyalkylene) monool has an average molecular weight of about 900 to about 1,500.

46. The fuel composition according to claim 30, wherein the oxyalkylene group of the hydrocarbyl-terminated poly-oxyalkylene group of said hydrocarbyl-terminated poly (oxyalkylene) monool is a $C_3$ to $C_4$ oxyalkylene group.

47. The fuel composition according to claim 46, wherein the oxyalkylene group of said hydrocarbyl-terminated poly (oxyalkylene) monool is a $C_3$ oxypropylene group.

48. The fuel composition according to claim 46, wherein the oxyalkylene group of said hydrocarbyl-terminated poly (oxyalkylene) monool is a $C_4$ oxybutylene group.

49. The fuel composition according to claim 30, wherein the hydrocarbyl group of said hydrocarbyl-terminated poly (oxyalkylene) monool is a $C_7$ to $C_{30}$ alkylphenyl group.

50. The fuel composition according to claim 30, wherein said carboxylic acid is 1 to about 15% of the weight of the Mannich condensation product.

51. The fuel composition according to claim 30, wherein $R_4$ represents a hydrocarbyl group having about 8 to about 30 carbon atoms and y represents an integer of 1.

52. The fuel composition according to claim 51, wherein $R_4$ represents a hydrocarbyl group having about 17 carbon atoms and y represents an integer of 1.

53. The fuel composition according to claim 30, further comprising a polyolefin polymer of a $C_2$ to $C_6$ mono-olefin, wherein the polymer has a number average molecular weight of about 500 to about 3,000.

54. The fuel composition according to claim 53, wherein the polyolefin polymer has a number average molecular weight of about 700 to about 2,500.

55. The fuel composition according to claim 54, wherein the polyolefin polymer has a number average molecular weight of about 750 to about 1,800.

56. The fuel composition according to claim 55, wherein the polyolefin polymer is a polymer of a $C_2$ to $C_4$ mono-olefin.

57. The fuel composition according to claim 56, wherein the polyolefin polymer is polypropylene or polybutene.

58. The fuel composition according to claim 57, wherein the polyolefin polymer is polyisobutene.

59. The fuel composition according to claim 30, wherein said composition comprises about 20 to about 1,000 ppm of the Mannich condensation product, about 10 to about 4,000 ppm of the hydrocarbyl-terminated poly(oxyalkylene) monool, and about 1 to about 100 ppm of the carboxylic acid.

60. The fuel composition according to claim 59, wherein said composition comprises about 30 to about 400 ppm of the Mannich condensation product, about 20 to about 800 ppm of the hydrocarbyl-terminated poly(oxyalkylene) monool, and about 1 to about 20 ppm of the carboxylic acid.

61. A fuel concentrate comprising an inert stable oleophilic organic solvent boiling in the range of from about 150° F. to about 450° F. and from about 10 to about 90 weight percent of an additive composition comprising:

a) a Mannich condensation product of (1) a high molecular weight alkyl-substituted hydroxyaromatic compound wherein the alkyl group has a number average molecular weight of from 300 to about 5,000 (2) an amine having the formula:

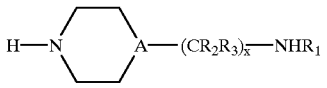

wherein A is CH or nitrogen, $R_1$, $R_2$, $R_3$ are independently hydrogen or lower alkyl of 1 to about 6 carbon atoms and each $R_2$ and $R_3$ is independently selected in each —$CR_2R_3$— unit, and x is an integer from 1 to about 6;

and (3) an aldehyde, wherein the respective molar ratio of reactants (1), (2), and (3) is 1:0.1–2:0.1–2;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group; and c) a carboxylic acid as represented by the formula:

$$R_4(COOH)_y$$

or anhydride thereof, wherein $R_4$ represents a hydrocarbyl group having about 2 to about 50 carbon atoms, and y represents an integer of 1 to about 4.

62. The fuel concentrate according to claim 61, wherein the alkyl group on said alkyl-substituted hydroxyaromatic compound has a number average molecular weight of about 400 to about 3,000.

63. The fuel concentrate according to claim 62 wherein the alkyl group on said alkyl-substituted hydroxyaromatic compound has a number average molecular weight of about 500 to about 2,000.

64. The fuel concentrate according to claim 63 wherein the alkyl group on said alkyl-substituted hydroxyaromatic compound has a number average molecular weight of about 700 to about 1,500.

65. The fuel concentrate according to claim 61, wherein said alkyl-substituted hydroxyaromatic compound is a polyalkylphenol.

66. The fuel concentrate according to claim 65, wherein the polyalkylphenol is polypropylphenol or polyisobutylphenol.

67. The fuel concentrate according to claim 66, wherein the polyalkylphenol is polyisobutylphenol.

68. The fuel concentrate according to claim 67, wherein the polyisobutylphenol is derived from polyisobutene containing at least about 70% methylvinylidene isomer.

69. The fuel concentrate according to claim 61, wherein A is CH or nitrogen, $R_1$ is hydrogen, $R_2$ and $R_3$ are independently hydrogen or lower alkyl having from 1 to about 4 carbon atoms, and x is an integer 1 to about 4.

70. The fuel concentrate according to claim 69, wherein A is CH or nitrogen, $R_1$ is hydrogen, $R_2$ and $R_3$ are independently hydrogen or lower alkyl having from 1 to about 2 carbon atoms, and x is an integer of about 2.

71. The fuel concentrate according to claim 70, wherein A is nitrogen, $R_1$, $R_2$, and $R_3$ are hydrogen, and x is an integer of about 2.

72. The fuel concentrate according to claim 61, wherein the aldehyde component of said Mannich condensation product is formaldehyde, paraformaldehyde, or formalin.

73. The fuel concentrate according to claim 61, wherein the respective molar ratio of reactants (1), (2), and (3) is 1:0.5–1.5:0.5–1.5.

74. The fuel concentrate according to claim 61, wherein the respective molar ratio of reactants (1), (2), and (3) is 1:0.8–1.3:0.8–1.3.

75. The fuel concentrate according to claim 61, wherein the respective molar ratio of reactants (1), (2), and (3) is 1:1:1.05.

76. The fuel concentrate according to claim 61, wherein said hydrocarbyl-terminated poly(oxyalkylene) monool has an average molecular weight of about 900 to about 1,500.

77. The fuel concentrate according to claim 61, wherein the oxyalkylene group of the hydrocarbyl-terminated poly-oxyalkylene group of said hydrocarbyl-terminated poly (oxyalkylene) monool is a $C_3$ to $C_4$ oxyalkylene group.

78. The fuel concentrate according to claim 77, wherein the oxyalkylene group of said hydrocarbyl-terminated poly (oxyalkylene) monool is a $C_3$ oxypropylene group.

79. The fuel concentrate according to claim 77, wherein the oxyalkylene group of said hydrocarbyl-terminated poly (oxyalkylene) monool is a $C_4$ oxybutylene group.

80. The fuel concentrate according to claim 61, wherein the hydrocarbyl group of said hydrocarbyl-terminated poly (oxyalkylene) monool is a $C_7$ to $C_{30}$ alkylphenyl group.

81. The fuel concentrate according to claim 61, wherein said carboxylic acid is 1 to about 15% of the weight of the Mannich condensation product.

82. The fuel concentrate according to claim 61, wherein $R_4$ represents a hydrocarbyl group having about 8 to about 30 carbon atoms and y represents an integer of 1.

83. The fuel concentrate according to claim 82, wherein $R_4$ represents a hydrocarbyl group having about 17 carbon atoms and y represents an integer of 1.

84. The fuel concentrate according to claim 61, further comprising a polyolefin polymer of a $C_2$ to $C_6$ mono-olefin, wherein the polymer has a number average molecular weight of about 500 to about 3,000.

85. The fuel concentrate according to claim 84, wherein the polyolefin polymer has a number average molecular weight of about 700 to about 2,500.

86. The fuel concentrate according to claim 85, wherein the polyolefin polymer has a number average molecular weight of about 750 to about 1,800.

87. The fuel concentrate according to claim 86 wherein the polyolefin polymer is a polymer of a $C_2$ to $C_4$ mono-olefin.

88. The fuel concentrate according to claim 87, wherein the polyolefin polymer is polypropylene or polybutene.

89. The fuel concentrate according to claim 88, wherein the polyolefin polymer is polyisobutene.

90. A method of improving the compatibility of a fuel additive composition, said method comprising blending together the components of the fuel additive composition of claim 1, wherein the Mannich condensation product and the carboxylic acid are blended together at a temperature in the range of about room temperature to about 100° C.

91. A method of controlling engine deposits in an internal combustion engine, said method comprising operating an internal combustion engine with the fuel composition of claim 30.

* * * * *